United States Patent [19]

Mori et al.

[11] 4,176,041

[45] Nov. 27, 1979

[54] METHOD FOR REFORMING LOW GRADE COALS

[75] Inventors: Kenji Mori, Nishinomiya; Mamoru Taniuchi; Shigeo Yaguchi, both of Kobe, all of Japan

[73] Assignee: Kobe Steel, Ltd., Kobe, Japan

[21] Appl. No.: 880,708

[22] Filed: Feb. 23, 1978

[30] Foreign Application Priority Data

Feb. 24, 1977 [JP] Japan ..... 52/19615
Feb. 25, 1977 [JP] Japan ..... 52/20531

[51] Int. Cl.[2] ..... C10G 1/06
[52] U.S. Cl. ..... 208/10
[58] Field of Search ..... 208/10

[56] References Cited

U.S. PATENT DOCUMENTS

| | | | |
|---|---|---|---|
| 2,377,728 | 6/1945 | Thomas | 208/10 X |
| 3,275,546 | 9/1966 | Retallick | 208/10 X |
| 3,671,418 | 6/1972 | Gatsis | 208/10 |
| 3,775,286 | 11/1973 | Mukherjee et al. | 208/10 |
| 3,884,794 | 5/1975 | Bull et al. | 208/10 X |

FOREIGN PATENT DOCUMENTS

| | | | |
|---|---|---|---|
| 23469 | of 1929 | Australia | 208/10 |
| 20992 | 1/1930 | Australia | 208/10 |
| 50-67801 | 6/1975 | Japan . | |
| 50-38702 | 10/1975 | Japan | 208/10 |
| 247584 | 6/1927 | United Kingdom | 208/10 |

*Primary Examiner*—Delbert E. Gantz
*Assistant Examiner*—William G. Wright
*Attorney, Agent, or Firm*—Oblon, Fisher, Spivak, McClelland & Maier

[57] ABSTRACT

In a method for reforming low grade coal to a carbonaceous material suitable for the production of metallurgical coke, steam coal (noncoking coal), such as subbituminous coal, brown coal, etc., is mixed with a catalyst, a co-catalyst (sulfur) and a hydrocarbonaceous heavy oil, and the mixture is thermally reformed in a reducing gaseous atmosphere at elevated pressure and temperature (400° to 450° C.) and the resultant reaction mixture is distilled at a reduced pressure of 40–150 mm Hg and at a temperature of 280° to 350° C. An iron type catalyst is used in proportions up to 3 wt.% based on the coal (on an ash-free, dry basis). The sulfur and heavy oil are recycled.

12 Claims, 1 Drawing Figure

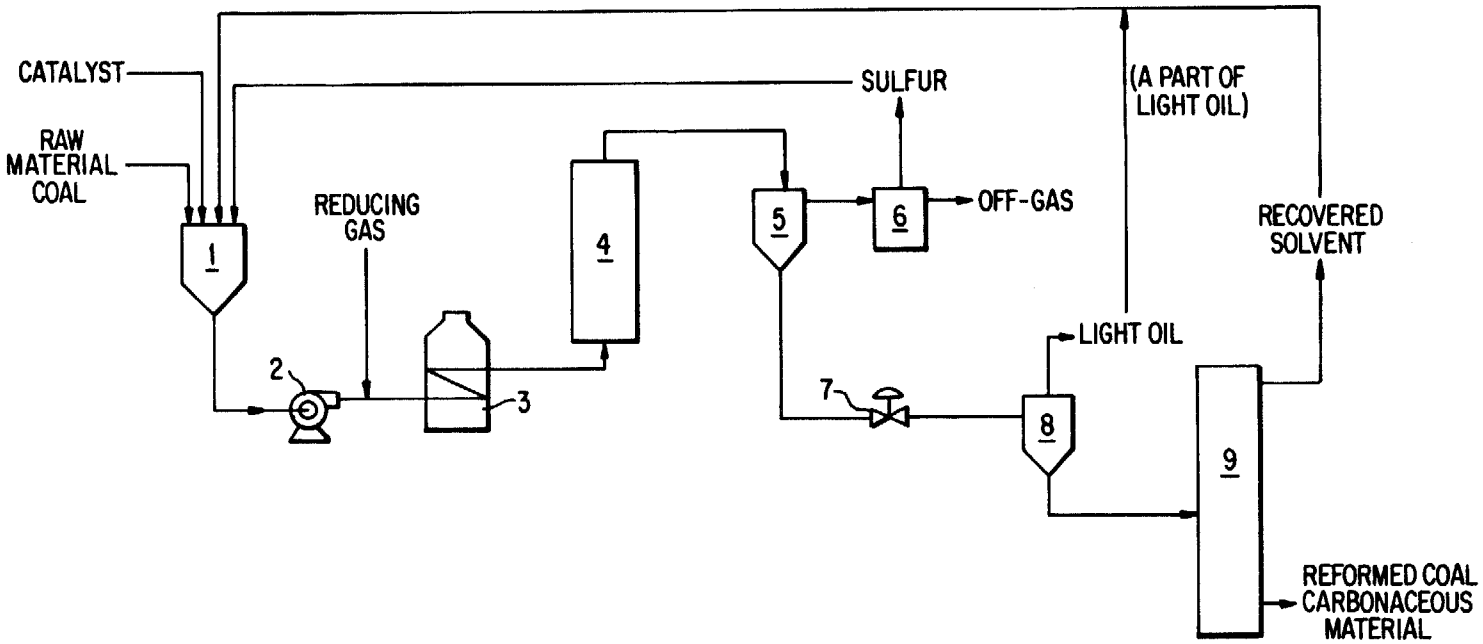
CATALYST
RAW MATERIAL COAL
1
2
REDUCING GAS
3
4
5
6
SULFUR
OFF-GAS
7
8
LIGHT OIL
(A PART OF LIGHT OIL)
RECOVERED SOLVENT
9
REFORMED COAL CARBONACEOUS MATERIAL

METHOD FOR REFORMING LOW GRADE COALS

BACKGROUND OF THE INVENTION

1. Field of the Invention

This invention relates to a method for reforming low grade coal to a carbonaceous material suitable for the production of metallurgical coke.

2. Brief Description of the Prior Art

Whilst improvements in the properties of coke, and particularly of metallurgical coke, have been desired because of the increasing scale of blast furnaces, heavy coking coal required for the production of good quality coke is available only in a limited number of countries, and it has now become increasingly difficult to secure a supply of such coal, both in terms of quantity and price. It appears that this trend will continue even with an increasing momentum, and it has been considered to be essential that a commercial process be developed for the production of metallurgical coke mainly from low grade coals such as steam coal (noncoking coal) and soft coking coal. Some techniques such as the briquette-blend coke production method, the preheated coal charging process and the formed coke production process have been developed and, though on a limited scale, have been put to commercial use.

Nonetheless, these known processes require a certain redesign of the coke oven, and it is difficult to produce coke using the existing equipment from a charge composed predominantly of low grade coals with any significant reduction in the blending ratio of heavy coking coal to the total charge of coal mixture.

Regarding the techniques hitherto known for reforming coal, the hydrotreating method has been available in many versions. However, these prior art processes generally consist of the steps of mixing a powdered coal with a hydrocarbon or other solvent and, if desired, further with a catalyst such as an iron-sulfur type or iron compound-sulfur type catalyst to prepare a slurry, passing the slurry through a pre-heater, adding a reducing gas, if desired, either before or after (preferably before) the preheating step, causing the preheated slurry to react with the reducing gas in a reactor at elevated temperature and pressure and separating the resultant reaction mixture into its gaseous, liquid and solid fractions. However, these methods are primarily intended to extract sulfur from coal, or to produce heavy oil. Because the quality of the product is considerably influenced by such factors as the degree of hydrogenation, reaction temperature and pressure, conditions under which the product is isolated, catalyst used, etc., they cannot be readily adapted to the reforming of low grade coals for the production of metallurgical coke.

SUMMARY OF THE INVENTION

In view of the above circumstances, this invention has as one of its objects to provide an efficient and economical method for producing a carbonaceous material for metallurgical coke from low grade coal.

It is another object of this invention to provide a method for producing such a carbonaceous material, which allows a significant reduction in the proportion of heavy coking coal in the coal mixture charge used for the production of metallurgical coke.

This invention relates, in one aspect, to a method for producing a reformed coal carbonaceous material suitable for the production of metallurgical coke which comprises slurrying a mixture of a steam coal (noncoking coal), the ash content of which is not more than 5 weight percent, an iron type catalyst in a proportion of no more than 3 weight percent, preferably 0.5 to 2 weight percent, based on said coal (on an ash-free, dry basis) and sulfur as a co-catalyst with a solvent, heating the resultant slurry in a reducing gas such as hydrogen or a gaseous mixture of carbon monoxide and steam at an elevated pressure and a temperature of 400° to 450° C. and distilling the resultant reaction mixture at a reduced pressure of 40 to 150 mmHg and a temperature in the range of 280° to 350° C.

In a second aspect, this invention relates to a method similar to the above first embodiment, wherein the starting material is sub-bituminous coal or brown coal.

In a third aspect, this invention relates to a method for producing a carbonaceous material for the production of metallurgical coke, which is similar to said first embodiment wherein the catalyst is an iron oxide catalyst.

In a fourth aspect, this invention relates to a method similar to the third embodiment wherein said iron oxide catalyst contains at least 40 weight percent of Fe.

In a fifth aspect, this invention relates to a method similar to the fourth embodiment wherein said catalyst is an iron oxide waste material such as blast furnace dust, converter dust, pelletizing plant dust, iron oxide sludge and/or the like.

In a sixth aspect, this invention relates to a method similar to the fifth embodiment wherein said iron oxide type waste material contains 40 to 70 weight percent of Fe, not more than 9 weight percent of Si and not more than 8 weight percent of Al.

In a seventh aspect, this invention relates to a method similar to any of the first seven aspects wherein said co-catalyst sulfur is the sulfur recovered from the heat-treating step.

BRIEF DESCRIPTION OF THE DRAWINGS

The accompanying drawing is a flow chart illustrating an embodiment of this invention.

DETAILED DESCRIPTION OF THE PREFERRED EMBODIMEMT

The method of this invention will be described by reference to the accompanying drawing.

In a slurry tank (1), a crushed and dried raw material coal, an iron oxide catalyst and a sulfur co-catalyst recovered from a desulfurization device (6) are admixed in predetermined proportions with a heavy hydrocarbon oil recovered from a distillation column (9) and a portion of the light oil recovered from a gas-liquid separator (8) to prepare a slurry. This slurry is transported by a slurry pump (2) to a preheater (3). In the meantime, a reducing gas such as hydrogen gas or a mixture of carbon monoxide gas and steam is added to the slurry. The slurry-reducing gas mixture thus preheated in the preheater (3) is fed to a reactor (4) in which it is subjected to a thermal decomposition and reforming reaction at 400–450 degrees centigrade and 50 to 300 atmospheres. During this reaction process, decomposition of the extracted coal fraction, promotion of decomposition by hydrogenation, stabilization of decomposition products, etc., as well as increases in molecular weight due to the repolymerization of decomposition products seem to proceed to cause the necessary reforming. This reaction mixture is guided to a gas-liquid separator (5) where gaseous components such as the hydrogen sulfide derived from the starting material coal, as well as residual reducing gas, etc. are separated and sent to the desulfurization device (6). The sulfur recovered in this device (6) is returned, as a co-catalyst, to the slurry tank (1), while the other gaseous components are removed as off-gas.

The liquid and solid fractions remaining in the gas-liquid separator (5) are flashed through a decompression valve (7) and sent to the gas-liquid separator (8). The light oil separated here is partially recovered for the preparation of the slurry. The remaining liquid and solid fractions are sent to the distillation column (9), in which they are distilled at 40–150 mmHg and 280° to 350° C. In this distillation column, not only the desired reformed coal carbonaceous material but also heavy oil is separated, the latter being recycled for the preparation of the slurry.

In the method of this invention, a low grade coal with an ash content of not more than 5%, i.e, steam coal (noncoking coal) and/or semi-soft coking coal (e.g., sub-bituminous coal, brown coal, etc., by type of coal) is employed as the starting material. The ash content of metallurgical coke is closely related to the coke ratio, productivity coefficient, etc., in blast furnace operations and the coal normally used for the production of metallurgical coke contains 6 to 13 percent of ash. The ash content of the reformed coal carbonaceous material according to this invention also is preferably in the neighborhood of 10 percent, although it may vary with the ash content of other coals to be blended in the production of coke. The general tendency is that the reformed coal carbonaceous material contains more ash than the starting coal as a result of concentration. From environmental and technological considerations, even the conventional reforming process includes a stage (deashing stage) where the ash-containing residue is separated so as to reduce the ash content. However, this process has the disadvantage that it is technically difficult to treat large amounts of ash thereby, and the deashing efficiency is poor. Therefore, the method of this invention dispenses with this deashing stage and, instead, employs a starting coal with an ash content not exceeding 5%, so that the ash content of the reformed coal carbonaceous material will be maintained in the neighborhood of 10 percent.

The solvent may be any type of solvent conventionally employed, such as hydrocarbons boiling at no less than 150° C. However, once the production process has been started, the heavy oil fraction from the distillation column is preferably recycled.

The method according to this invention involves the employment of an iron type catalyst in a proportion of no more than 3 weight percent, preferably 0.5 to 2 weight percent, based on the weight of the starting coal (on an ash-free, dry basis). As preferred examples of said catalyst may be mentioned ferrous oxide, purified iron powder, ferric oxide and so on. The iron content of such iron type catalyst is not less than 40 weight percent. A number of coal-reforming catalysts are known, including cobalt-molybdenum catalyst, zinc chloride, tin chloride, etc. However, in order that the aforesaid deashing step be omitted, and to preclude untoward effects of impurities on the iron-making process for which the product coke is intended, it is particularly advisable to employ an iron-type catalyst. Moreover, the use of a starting coal containing no more than 5% of ash and the use of an iron catalyst in a proportion of no more than 3% based on said coal enables one to maintain the ash content of the reformed coal carbonaceous material in the neighborhood of 10 percent. Since the catalyst is not recycled in the present process, it is desirable to employ an inexpensive type of catalyst and the various iron oxide wastes available from iron-making facilities can be effectively utilized for this purpose. The use of such iron oxide wastes as catalysts is known in the art of removing nitrogen oxides from waste gas (Japanese patent application laid open No. 101275/1975) but credit is due us for the finding that such wastes are useful also in the art of coal reforming. The process of this invention is, therefore, also beneficial as a method for treating such industrial wastes.

Thus, these wastes include, among others, dusts of iron ore used as a raw material for iron, dusts of powdered ore for the sintering furnace, the alloyed iron scale containing silicon, manganese, nickel, chromium and other alloying metals which are auxiliary materials, the scale from rolling mills, the dusts available from the dust collectors and eliminators in various iron and steel mills (e.g. blast furnace dust, converter dust, etc.), iron oxide sludges and so forth. Any of these waste materials are normally crushed, granulated, screened, classified and otherwise treated prior to use as the catalyst.

Generally, when such an iron-oxide type catalyst is employed in the thermal decomposition-reforming reaction of coal, its catalytic activity is influenced by its purity and the form of the iron oxide. When iron ore, for instance, is used as the catalyst, its activity is not as high as might be expected from the iron content if the iron is present in the form of its silicate. The iron oxide wastes available from iron-making plants contain large amounts of high-purity iron oxides, and have high catalytic activity. For the purposes of this invention, those wastes containing no less than 40 weight percent, preferably 40 to 70 weight percent, of Fe, no more than 9 wt.% of Si and 8 wt.% of Al are desirable. While these wastes are generally utilized for the production of iron oxide pigments and other products in the iron-making industry, it has not been known to utilize such waste materials directly as the catalyst for the liquefaction of coal. Such iron oxide wastes are trapped, crushed, granulated or otherwise treated as mentioned hereinbefore. The resultant granules can be employed either as such or after simple screening. The advantages of these granules are that they have excellent catalyst activity and are easy to handle and readily available at low cost.

In the practice of this invention, to enhance the catalytic activity of such a granular iron oxide preparation, sulfur is employed as a co-catalyst. The co-catalyst sulfur is preferably the sulfur which is recovered from the process itself. Generally, the sulfur contained in coal is separated in the reforming process as hydrogen sulfide, and has heretofore been removed after conversion to solid sulfur by the Stretford or other desulfurization process. The reuse of sulfur in accordance with this invention is highly beneficial in that it provides a closed system for sulfur.

The thermal decomposition/reforming reaction according to this invention is conducted in a reducing gas such as hydrogen or carbon monoxide-steam and under conditions otherwise similar to the conventional conditions, e.g. at a pressure of 50 to 300 atmospheres and a temperature in the range of 400° to 450° C.

The following table shows the properties of reformed coal carbonaceous material obtained by the reactions at an initial hydrogen pressure of 60 kg/cm$^2$ and at various temperatures.

Table 1

| Properties | Temperature 400° C. | 430° C. |
|---|---|---|
| Ha (%) | 47.1 | 52.8 |
| Hα (%) | 23.0 | 24.1 |
| Ho (%) | 29.9 | 23.1 |

In Table 1, Ha denotes the amount of hydrogen on an aromatic ring in the reformed coal carbonaceous material as determined by nuclear magnetic resonance (NMR) spectrometric analysis; Hα denotes the amount of hydrogen on aliphatic carbon atom α to an aromatic ring as similarly determined; and Ho denotes the amount of hydrogen on aliphatic carbon atoms β or further to an aromatic ring as similarly determined. Comparison of the properties of the reformed carbonaceous material obtained at 400° C. with those of the carbonaceous material obtained at 430° C. indicates that the reformed product obtained at 400° C. has a higher value of Ho than of Hα. This means that the length of its side chain, i.e. the length of its aliphatic moiety, is long, and that its degree of reforming is lower than that of the product obtained at 430° C. It is generally acknowledged that reformed coal products with short aliphatic chains are desirable for the production of metallurgical coke and the low temperature of 400° C. is unsuitable because it still yields a higher value of Ho than of Hα.

Table 2

| Properties | Temperature 430° C. | 450° C. |
|---|---|---|
| Coking fraction (%) | 81 | 74 |
| Noncoking fraction (%) | 19 | 26 |

In Table 2, the noncoking fraction means the amount of unreacted coal, catalyst and ashes in the reformed coal carbonaceous material. It will be seen from Table 2 that the proportion of the noncoking fraction increases with temperature and that temperatures beyond 450° C. are not desirable. In view of the foregoing results, it is clear that the thermal decomposition reforming reaction according to this invention is preferably conducted at a temperature in the range of 400° to 450° C.

In the method of this invention, distillation is carried out at a reduced pressure of 40 to 150 mmHg and a temperature in the range of 280° to 350° C. to remove the light fractions and thereby to obtain the contemplated reformed coal carbonaceous material suitable for the production of metallurgical coke. At a temperature below the aforesaid range and/or a pressure in excess of the aforementioned pressure range, the product reformed coal carbonaceous material would contain an excess of volatile components, while at a high temperature beyond the aforementioned range and/or at a pressure below the aforementioned pressure range, not only is the yield of reformed product too low but the carbonization reaction proceeds too far to provide the desired carbonaceous material.

In accordance with this invention which has been described hereinbefore, there is economically and efficiently obtained a reformed coal carbonaceous material suitable for the production of metallurgical coke, that is to say a reformed product in which the atomic oxygen-to-carbon ratio is not more than 0.05:1, preferably not more than 0.04:1 and the atomic hydrogen-to-carbon ratio is in the range of 0.5 to 1.0:1, preferably from 0.6 to 0.8:1.

The following examples are further illustrative but by no means limitative of this invention.

EXAMPLE 1

A brown coal with an ash content of 0.8% (carbon content: 68% on an ash-free, dry basis) was finely pulverized and 3.0% (on said ash-free, dry basis) of commercial ferric oxide was added together with a molar equivalent (based on Fe in the ferric oxide) of sulfur. The coal mixture was slurried using a recovered solvent (a coal-based heavy oil boiling at 200°–420°C.) and a thermal decomposition and reforming reaction was carried out in an atmosphere of hydrogen gas introduced at an initial pressure of 60 atms, at an elevated pressure of 140 to 160 atms and a temperature of 430° C. The slurry was then distilled at a reduced pressure of 90 mmHg and at 310° C. to obtain a reformed coal carbonaceous material. The properties of this reformed coal carbonaceous material are set forth in Table 3.

Table 3

| | | | |
|---|---|---|---|
| Proximate analysis | Ash | (%) | 5.4 |
| | Volatile matter | (%) | 45.6 |
| | Fixed carbon | (%) | 48.7 |
| | Water | (%) | 0.3 |
| Ultimate analysis | C | (%) | 90.1 |
| | H | (%) | 4.8 |
| | N | (%) | 1.7 |
| | S | (%) | 1.6 |
| | O | (%) | 1.8 |

The resultant reformed coal carbonaceous material was admixed with different coals for coke production and the mixture was coked in a small 1.5 kg retort (Japanese Industrial Standard M 8801). The formulations used and the properties of the product cokes are set forth in Table 4.

Table 4

| Coal | Comparative Example | Blended with reformed coal carbonaceous material |
|---|---|---|
| Heavy coking coal | 55% | 35% |
| Medium coking coal | 25 | 20 |
| Soft coking coal | 10 | 10 |
| Domestic coal | 10 | 10 |
| Steam coal | — | 15 |
| Reformed coal | — | 10 |
| Strength of coke ($DI_{15}^{30}$%) | 92.1 | 92.5 |

EXAMPLE 2

The procedure of Example 1 was repeated except that a converter dust was used as the catalyst to produce a reformed coal carbonaceous material. The proximate and ultimate analyses of this carbonaceous material are given in Table 5.

Table 5

| | | | |
|---|---|---|---|
| Proximate analysis | Ash | (%) | 5.3 |
| | Volatile matter | (%) | 37.0 |
| | Fixed carbon | (%) | 57.5 |
| | Moisture | (%) | 0.3 |
| Ultimate analysis | C | (%) | 90.8 |
| | H | (%) | 4.4 |
| | N | (%) | 1.7 |

Table 5-continued

| | | |
|---|---|---|
| S | (%) | 1.3 |
| O | (%) | 1.8 |

Using the above reformed coal carbonaceous material, coke was produced by a procedure similar to that described in Example 1. The formulations used and the properties of the coke obtained are set forth in Table 6.

Table 6

| Coal | Comparative Example | Blended with reformed coal carbonaceous material |
|---|---|---|
| Heavy coking coal | 55% | 24% |
| Medium coking coal | 25 | 20 |
| Soft coking coal | 10 | 10 |
| Domestic coal | 10 | 10 |
| Steam coal | — | 15 |
| Reformed carbonaceous material of Example 2 | — | 10 |
| Strength of coke ($DI_{15}^{30}$%) | 92.1 | 92.3 |

It will be apparent from Tables 4 and 6 that whereas the drum index ($DI_{15}^{30}$) of the coke produced by coking the prior art formulation rich in strongly coking coal was 92.1, the drum index ($DI_{15}^{30}$) of the cokes produced by coking the formulations lean in strongly coking coal but with the addition of the reformed coal carbonaceous material of this invention were 92.5 and 92.3. These values are sufficiently high to make the cokes applicable to the large-sized blast furnaces used in recent years, indicating that the reformed coal carbonaceous material of this invention meets the desired objects.

What is claimed is:

1. A method for reforming low grade coal for the production of metallurgical coke which comprises:

admixing a steam coal, the ash content of which is not more than 5 weight percent, an iron oxide catalyst containing at least 40 weight percent of iron in a proportion of no more than 3 weight percent based on said coal, on an ash-free, dry basis and sulfur as a co-catalyst with a solvent to prepare a slurry;

heat-treating the slurry in a reducing gaseous atmosphere at an elevated pressure and at a temperature in the range of 400° to 450° centigrade; and distilling the resultant reaction mixture at a reduced pressure of 40 to 150 mmHg and an elevated temperature of 280° to 350° centigrade to separate a reformed coal carbonaceous material suitable for the production of metallurgical coke.

2. A method for reforming low grade coal as set forth in claim 1 wherein said low grade coal is sub-bituminous coal.

3. A method for reducing low grade coal as set forth in claim 1 wherein said low grade coal is brown coal.

4. A method for reforming low grade coal as set forth in claim 1 wherein said catalyst is an iron oxide-containing waste material.

5. A method for reforming low grade coal as set forth in claim 4 wherein said iron oxide-containing waste material is selected from the group consisting of blast furnace dust, converter dust, pelletizing plant dust and spent acid sludge.

6. A method for reforming low grade coal as set forth in claim 4 wherein said iron oxide-containing waste material contains 40 to 70 weight percent of Fe, no more than 9% weight percent of Si and no more than 8 weight percent of Al.

7. A method for reforming low grade coal as set forth in claim 1 wherein said sulfur is the sulfur recovered from the thermal reforming of coal.

8. A method for reforming low grade coal as set forth in claim 1 wherein said solvent is a heavy hydrocarbon oil.

9. A method for reforming low grade coal as set forth in claim 1 wherein said solvent is the solvent recovered from a stage for the thermal reforming of coal.

10. A method for reforming low grade coal as set forth in claim 1 wherein said reducing gas is hydrogen.

11. A method for reforming low grade coal as set forth in claim 1 wherein said reducing gas is a mixture of carbon monoxide and steam.

12. A method for reforming low grade coal as set forth in claim 1 wherein said catalyst is employed in an amount of 0.5 to 2 weight percent on said basis.

* * * * *